US011842588B2

(12) United States Patent
Senese et al.

(10) Patent No.: US 11,842,588 B2
(45) Date of Patent: Dec. 12, 2023

(54) SYSTEM FOR CONTROLLING ACCESS TO AN ENCLOSURE

(71) Applicant: Panduit Corp., Tinley Park, IL (US)

(72) Inventors: John C. Senese, Naperville, IL (US); Michael J. Ellis, Minooka, IL (US); Rachel M. Bugaris, Lexington, KY (US)

(73) Assignee: Panduit Corp., Tinley Park, IL (US)

( * ) Notice: Subject to any disclaimer, the term of this patent is extended or adjusted under 35 U.S.C. 154(b) by 23 days.

(21) Appl. No.: 17/592,717

(22) Filed: Feb. 4, 2022

(65) Prior Publication Data

US 2022/0254208 A1 Aug. 11, 2022

Related U.S. Application Data

(60) Provisional application No. 63/148,677, filed on Feb. 12, 2021, provisional application No. 63/146,751, filed on Feb. 8, 2021, provisional application No. 63/146,746, filed on Feb. 8, 2021.

(51) Int. Cl.
*G07C 9/00* (2020.01)
*G07C 9/20* (2020.01)

(52) U.S. Cl.
CPC ..... *G07C 9/00896* (2013.01); *G07C 9/20* (2020.01); *G07C 2209/63* (2013.01)

(58) Field of Classification Search
None
See application file for complete search history.

(56) References Cited

U.S. PATENT DOCUMENTS

| | | | | |
|---|---|---|---|---|
| 6,703,938 | B1 * | 3/2004 | Clarke | G01R 19/155 340/687 |
| 6,720,861 | B1 | 4/2004 | Rodenbeck et al. | |
| 8,013,613 | B2 * | 9/2011 | Allen, Jr. | G01R 19/155 324/522 |
| 8,264,322 | B2 | 9/2012 | Rodenbeck et al. | |
| 8,665,064 | B1 | 3/2014 | Rodenbeck et al. | |
| 8,888,002 | B2 | 11/2014 | Marshall et al. | |
| 9,057,210 | B2 | 6/2015 | Dumas et al. | |
| 9,378,598 | B2 | 6/2016 | Dumas et al. | |
| 9,852,561 | B2 | 12/2017 | Dumas et al. | |
| 9,984,524 | B2 | 5/2018 | Fares et al. | |
| 2010/0033190 | A1 * | 2/2010 | Devine | G01R 19/145 324/537 |
| 2010/0045464 | A1 | 2/2010 | Knopf et al. | |
| 2020/0408812 | A1 * | 12/2020 | Bugaris | G01R 19/155 |

OTHER PUBLICATIONS

Bugaris Rachel M: "Improving Electrical Safety in the Workplace: Applying Prevention Through Design to Voltage Testing",IEEE Industry Applications Magazine, IEEE Service Center, Piscataway, NJ, US, vol. 23, No. 3, May 1, 2017 (May 1, 2017), pp. 12-23, XP011645395, ISSN: 1077-2618, DOI: 10.1109/MIAS.2016.2600724, Retrieved Aug. 8, 2022.

* cited by examiner

*Primary Examiner* — K. Wong
(74) *Attorney, Agent, or Firm* — Christopher S. Clancy; James H. Williams; Christopher K. Marlow

(57) ABSTRACT

A method of providing a user access to an enclosure with an absence of voltage testing device (AVT) includes initiating an absence of voltage test, determining whether the user has appropriate authorization, and providing access to the enclosure.

6 Claims, 8 Drawing Sheets

Pictorial Example of Multiple Factor Hardware Confirmation to Access Electrical Panel Systems Test Process Chart Pictorial Example of Multiple Factor Hardware Confirmation to Access Electrical Panel Systems Test Process Chart Monitoring Process Chart System Details and Components Details of Beacon I/O Box Object/Device Examples:

| | | | | |
|---|---|---|---|---|
| Safety cone | Hard Hat | Safety Jacket | Safety Glasses | Smart Glasses |

Example of restricted area floor plan

AVT integration with indicator

SYSTEM FOR CONTROLLING ACCESS TO AN ENCLOSURE

CROSS REFERENCE TO RELATED APPLICATION(S)

This application claims benefit to U.S. Provisional Patent Application No. 63/146,746, filed on Feb. 8, 2021; U.S. Provisional Patent Application No. 63/146,751, filed on Feb. 8, 2021; and U.S. Provisional Patent Application No. 63/148,677, filed Feb. 12, 2021, the entirety of which is hereby incorporated by reference herein.

FIELD OF THE INVENTION

The present invention is generally directed towards controlling access to an enclosure and more specifically to using an absence of voltage testing device combined with a wearable device to control access to an enclosure.

BACKGROUND

Absence of voltage testers (AVT) allow an individual to activate an electrical test that confirms the absence of voltage inside different types of electrical panels. The AVT can be equipped with access control hardware to keep the electrical panel door locked unless the AVT confirms that absence of voltage. If the panel door is not equipped with access control hardware an alternative option is to indicate the current condition with an audible horn, light stack, or similar indication device. Basically, the electrical test determines if any unsafe voltage is detected and that the detection leads are properly connected. However, this electrical test can be performed by anybody in front of the electrical panel and if not equipped with a locking mechanism the person can open the electrical panel door without running the test.

It is vitally important to properly train any person opening an electrical panel to reduce the risk of injury. Most incidents relating to electrical safety stem from lack of training and knowledge gaps on how to lower the risk of an electrical hazard. One benefit of the invention described within this document is to provide a method and device to validate that the person accessing the electrical panel has had proper training and is present when the panel is accessed.

Automating safety procedures result in increased usage and improves the overall effectiveness of the procedure. An opportunity exists to notify a person, qualified or non-qualified, using a wearable or mobile device, of nearby hazardous voltage. The system's capability includes monitoring an area or electrical enclosure for voltage and then notifying a person when they are in proximity to that area.

Presence sensing for people and equipment is increasing in popularity, but the safety market has not captured the full potential of this technology. Wireless technology is advancing in this area and there are several ways to implement such a system, but an opportunity exists for deploying a simple system that only tracks location when needed. Many incidents that occur in manufacturing plants are direct results of lack of training and personnel engaging in something that they are not qualified. Therefore, having the ability to notify the person that they are in a restricted area, or engaging in a restricted activity such as opening an electrical panel, can provide a safer work environment. A restricted area may be related to a health/safety hazard, an area where intellectual property may exist, or any reason dictated by the owner of the area. Often in manufacturing facilities certain processes can be considered proprietary and only certain personnel will have access. Minimally the system can provide a log of the restricted area that indicates who was present and what other equipment/devices were in the area.

Continuously tracking people can be viewed as an invasion of privacy and often creates discomfort for individuals. The advantage of this type of system is that there is only notification when the person or equipment enters an area that is being monitored. This provides more privacy to the individuals and deployment of this type of system is simpler and more cost effective.

Safety programs often require the use of different types of safety products, but it can be difficult to confirm that the proper procedures are followed. Having a system that can provide confirmation that the correct products were used helps to increase the level of safety. Example of safety products for this process include personal protective gear (hard hat, glasses, jacket, etc.), safety cones, locks, and other related products that are listed in a safety policy. Each of these safety products can be affixed with a wireless sensor that will be detected when in the appropriate area.

SUMMARY

A method of providing a user access to an enclosure with an absence of voltage testing device (AVT) includes initiating an absence of voltage test, determining whether the user has appropriate authorization, and providing access to the enclosure.

DETAILED DESCRIPTION OF THE INVENTION

For a typical application, the person with a wearable or mobile device approaches the electrical panel, the transmitter will stream out a set of data that is read by the receiver. If the wearable/mobile device data provides proper authorization, and a successful absence of voltage test is completed directly on the absence of voltage tester or remotely, then the panel is unlocked, and the person is granted access. The absence of voltage test may be triggered by a user prompt or automatically via AVT, triggered based on wristband or mobile device proximity to a restricted area, work order system or another type of software interface, or combination of some of the above conditions.

For a qualified person that enters an area, or enclosure, the system can be set up to continuously monitor for voltage presence and/or absence of voltage. This is accomplished by acknowledging that voltage is detected or an absence of voltage test is automatically initiated and the results are communicated to this qualified person. The results can be communicated in a variety of ways. Some examples are physically preventing access (such as an enclosure lock), or alerting based via an audible horn, stack light, or other similar indicating devices used in various combinations in addition to or in place of a physical lock. In this case, the person will automatically be notified anytime when in proximity to the area/enclosure. This method saves the time and effort of initiating a manual test or other type of evaluation.

In some cases, the system may require other equipment, such as PPE with built in transmitter that must be in proximity. If the person does not have proper authorization, or any required equipment is not detected, then the electrical panel will remain locked or appropriate feedback will be provided based on system configuration.

Figure 1:
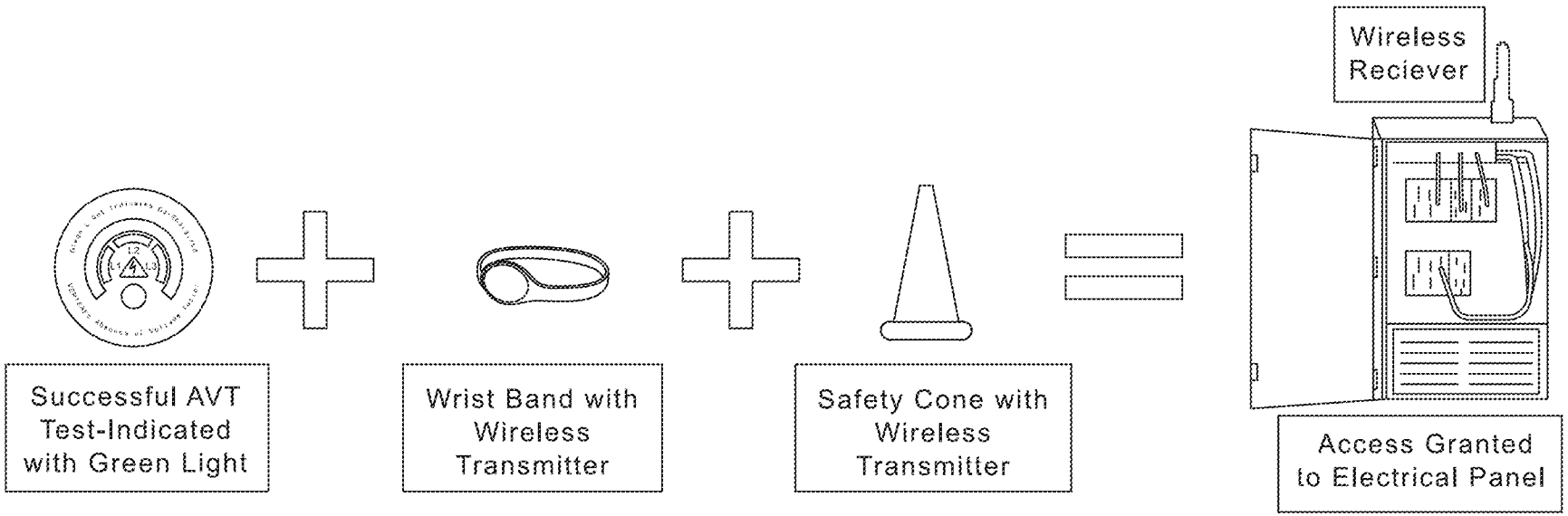
FIG. 1 is a pictorial example of multiple factor hardware confirmation to access electrical panel.

The core elements of the system are show in FIG. 1. Upon a successful test from the AVT the system will determine if the additional required elements are within proximity to the system. If all the required devices are confirmed by the system, then the panel is unlocked (or just logged in the software if the system is not equipped with a physical lock). Alternatively, other feedback can be provided when unauthorized access occurs. The results can be communicated in a variety of ways. Some examples are physically preventing access (such as an enclosure lock), or alerting based via an audible horn, stack light, or other similar indicating devices used in various combinations in addition to or in place of a physical lock.

The overall system starts with an absence of voltage tester and the functionality is enhanced with access control and a wireless validation system. The wireless validation system will serve as the authentication component for confirming that all required personnel and equipment is present before allowing entry to the electrical control panel. Typically, a company's safety plan will dictate the requirements for opening an electrical control panel.

Depending on the application, the associated safety plan may require certain precautions such as personal protection equipment (PPE), having a supervisor present, or obtaining a work permit or other type of documentation. If certain PPE is required, this equipment can be configured with a wireless transmitter device that provides validation. For example, if a hard hat is required, the system will look for a wireless signal that indicates the detection of a hard hat. This assumes that the hard hat will have a built-in wireless transmitter. Another example is the requirement of a work permit. If the proper work permit has not been obtained the system will not allow access regardless of who tries to enter. A physical transmitter device, such as a wrist band, could be issued with the work permit and be required for entry into the electrical panel. Utilizing these extra steps for safety reduces the overall risk. When the system requires more than one piece of information from a person or equipment then this is referred to as multi-factor authentication.

At any time, a person's access level can be changed to allow or deny access. This is accomplished through a software application. The transmitters are setup to continuously send out wireless communications that include a unique identification. This unique identification is captured in the system anytime it is read and can be logged therefore providing historical data. Information on when and who accessed the electrical panel is readily available. This data is useful for tracking electrical problems and if there are any safety violations and/or injuries the log can be accessed. Electrical panels are accessed for moves/adds/changes or troubleshooting problems so having an access log can help with maintenance and identifying issues. Managing electrical panel access can be controlled dynamically through application software. If a person needed to update their training or was leaving the company the access privileges can be quickly changed in the system without needing to access the actual transmitter or receiver. The training can be specific to different types of equipment and hazard levels. Therefore, a person allowed into a low voltage panel may not have access to a motor control center with medium voltage.

Providing power for the AVT is independent of the electrical panel power (tester must be able to operate when panel is de-energized). Similarly, this invention will require a power source that is available when the electrical panel is being tested and also must be a low power device that does not create an electrical hazard. Powering the invention device can be accomplished with any of the following: battery, stored energy device, energy harvesting device, or connection to a low voltage remote power supply.

Basically, the system can be summarized in four main steps:

1. Determine absence of voltage utilizing AVT product.
2. Validate that all required people and equipment are in proximity.
   a. This is determined by the wireless validation system.
3. Upon confirming first 2 steps then unlock electrical control panel or indicate unsafe state with other means.
4. Monitor that the required people and equipment are in range while electrical control panel is open.

The system described in this application builds upon the function of a permanently installed absence of voltage tester. The AVT communicates the result following an absence of voltage test via signaling contacts or a network interface to an access control locking mechanism or other method of indication. The invention provides a method to validate that an authorized person and/or equipment is within a certain range of the electrical panel prior to accessing the panel. Similarly, it could be used to determine that unauthorized person(s) or equipment are in the defined range while accessing an electrical control panel. For example, if contractors are not allowed to be near open electrical panels the system can take note of this and report it to the proper personnel.

The information from people or equipment is acquired through a wireless system containing a transmitter and receiver (Bluetooth low energy, NFC, or other type of wireless). Typically, the receiver device is installed on or near the electrical panel and the transmitter is located on the person or equipment, although the transmitter and receiver device can be on either side. The device located on the person or equipment will be in the form of a wearable device or a mobile device. The invention provides an interlock between unlocking the access control lock (or similar type of output) on the electrical panel and successfully completing an absence of voltage test. Prior to unlocking the access control lock the system will confirm that the unique identification on the person or equipment has been approved and the AVT has performed a successful test. Combining the information from the wireless validation system with an absence of voltage tester with access control provides an additional level of electrical safety and equipment security.

Figure 2:
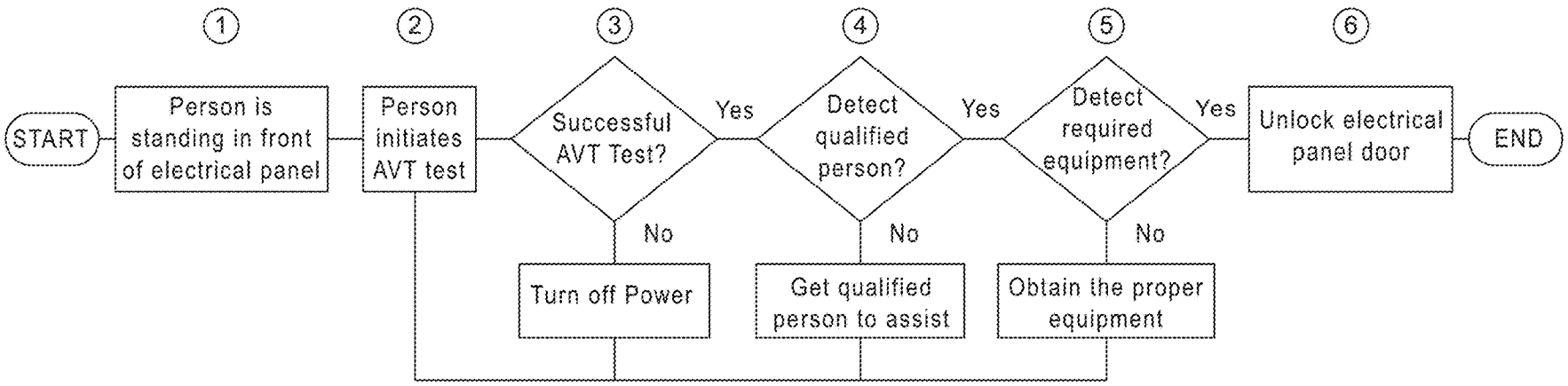
FIG. 2 is a flow chart showing the process of accessing an electrical enclosure according to one embodiment of the present invention.

FIG. 2 represents the process of entering an electrical panel with AVT and access control setup:

1. Person with wearable or mobile device approaches electrical panel.
2. Person initiates AVT test by pressing the button on the device.
3. AVT determine absence of voltage and provides indication if the system passed.
4. The wireless system determines if a qualified person is standing near the panel. If no qualified person is available, the system test ends.
5. After confirming a qualified person is near then the system looks for any required equipment. If the proper equipment is not identified by the wireless system, the system test ends.
6. Once the required equipment is confirmed the system unlocks the panel door and allows the person to open it. Once the panel door is closed the system is reset and reentry requires running the test again.

Figure 3A:
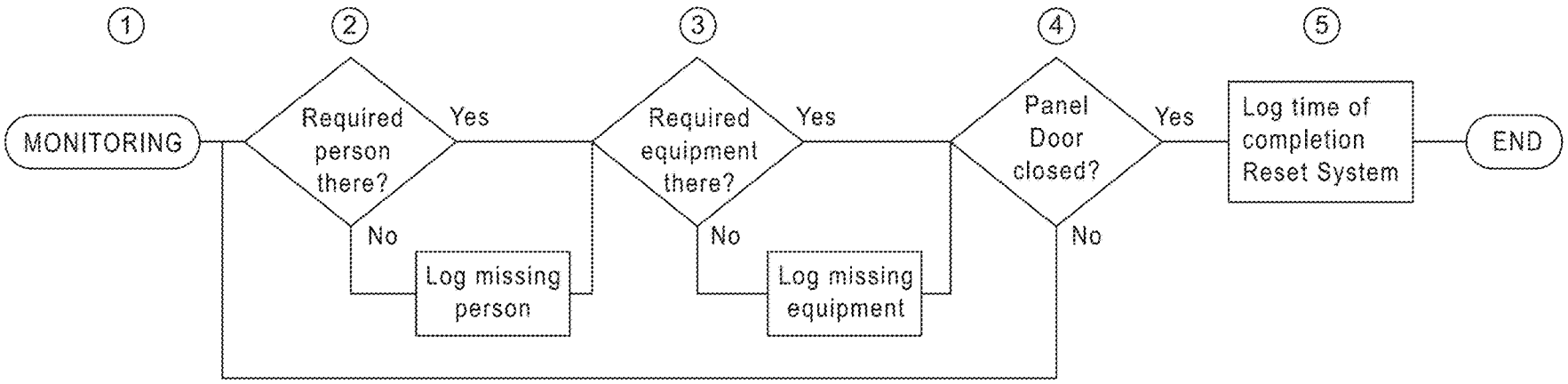
FIG. 3*a* is a flow chart showing how the logic is performed for the continuous monitoring of the system.
Figure 3B:
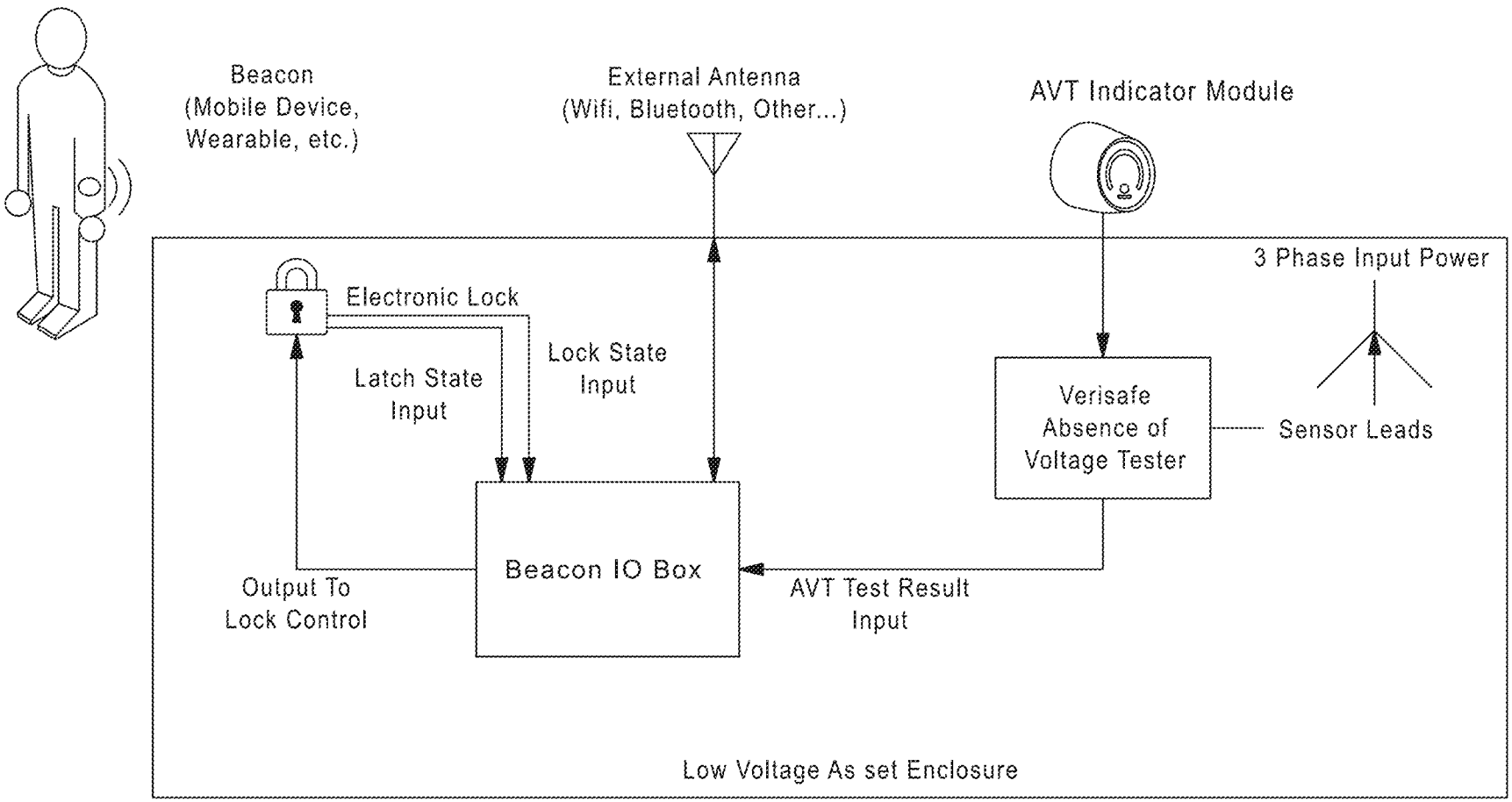
FIG. 3*b* shows the components of a system for allowing access to an enclosure.

After the electrical panel door has been opened, per the steps listed above, the system continues to monitor the surroundings. All the required people and equipment must always be present otherwise the system will log any issues. For example, if a safety person is required to be present and leaves the area the event will be captured in the log. In addition, an external output, such as an indicator light or audible alarm, can be triggered to indicate to people nearby that there is an issue. This functionality provides a history of showing how the safety procedures are being followed. The system monitoring will only reset after the electrical control panel door has been closed and verified electronically by the system. After the door has been closed and locked it cannot be re-opened unless the entire process from FIG. 2 is repeated. FIG. 3 shows how the logic is performed for the continuous monitoring of the system.

FIG. 3 is a representation of the system components and how they interact with each other. Each component of the system is described below:

AVT Indicator Module: Standard AVT performs the absence of voltage test on the system and provides a pass/fail result. The connection shown in FIG. 3 corresponds to testing a 3-phase input power system with the AVT sensor leads. Passing result is indicated with green light and test result is communicated to Beacon I/O box.

External Antenna: The antenna can be mounted internally or externally depending on the application. For applications involving electrical control panels most of the time the signal will be stronger when using an external antenna due to the interference of a metal enclosure. The antenna can be used to communicate via Bluetooth, Wi-Fi, or another wireless signal.

Electronic Lock: Any type of electronic lock can be utilized with the system. In this example the lock has some built in intelligence that indicates the lock status. The latch state input and lock state input both provide a binary signal that is communicated to the Beacon I/O box. In addition to the two inputs the output lock to control signal is how the Beacon I/O box controls the state of the electronic lock. These three signals are used by the system to confirm the operation of locking and unlocking. The electronic lock can be used optionally and is not required.

Figure 4:
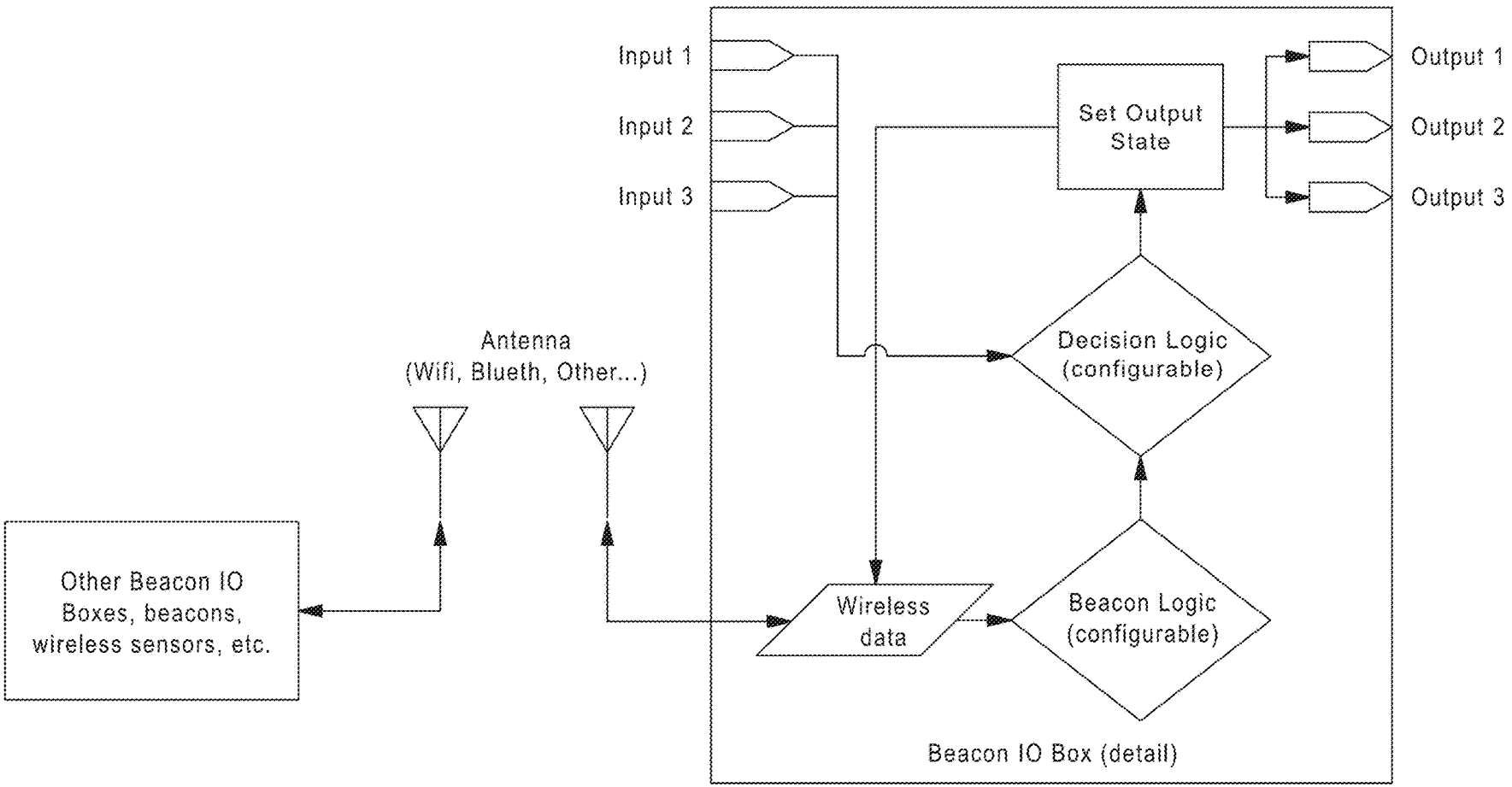
FIG. 4 is a pictorial representation of the contents of the Beacon I/O Box.

Beacon I/O Box: The Beacon I/O box is the center of communication for the system. All the necessary logic to run the system is contained in the Beacon I/O box. FIG. 4 is a pictorial representation of the contents of the Beacon I/O Box.

Inputs 1,2, and 3: Three MOSFET inputs sinking internal pull up to input voltage Outputs 1,2, and 3: Three MOSFET open drain output, sinking.

Beacon Logic: Configurable beacon scanner able to output logic states based on beacon data received. Example uses are to control access to assets, trigger alarm states based on proximity or in general control output states based on data content and proximity. Fully configurable settings based on distance and content.

Decision Logic: Configurable decision logic with the ability to consume discrete inputs, local beacon logic and external beacon data to set output states. These output states include but are not limited to discrete outputs and integration to other systems.

Typical Devices used Include:

Absence of voltage tester: Panduit AVT module or equivalent absence of voltage tester.

Wearable device examples: Wrist band, ID card, or any type of electronics built into or attached to clothing or equipment.

Mobile device examples: Cellular phones and tablets.

A second aspect of the invention described within this application is for confirming the presence of an equipment/device for the use of a safety system utilizing wireless technology. Each object required will be setup with a sensor that transmits wirelessly (Bluetooth low energy, NFC, or other type of wireless technology). The invention provides a method to validate these object/devices are within a certain range of the desired area. Typically, the receiver device is installed near the desired area and the transmitter is located on the object/devices.

Figure 5:
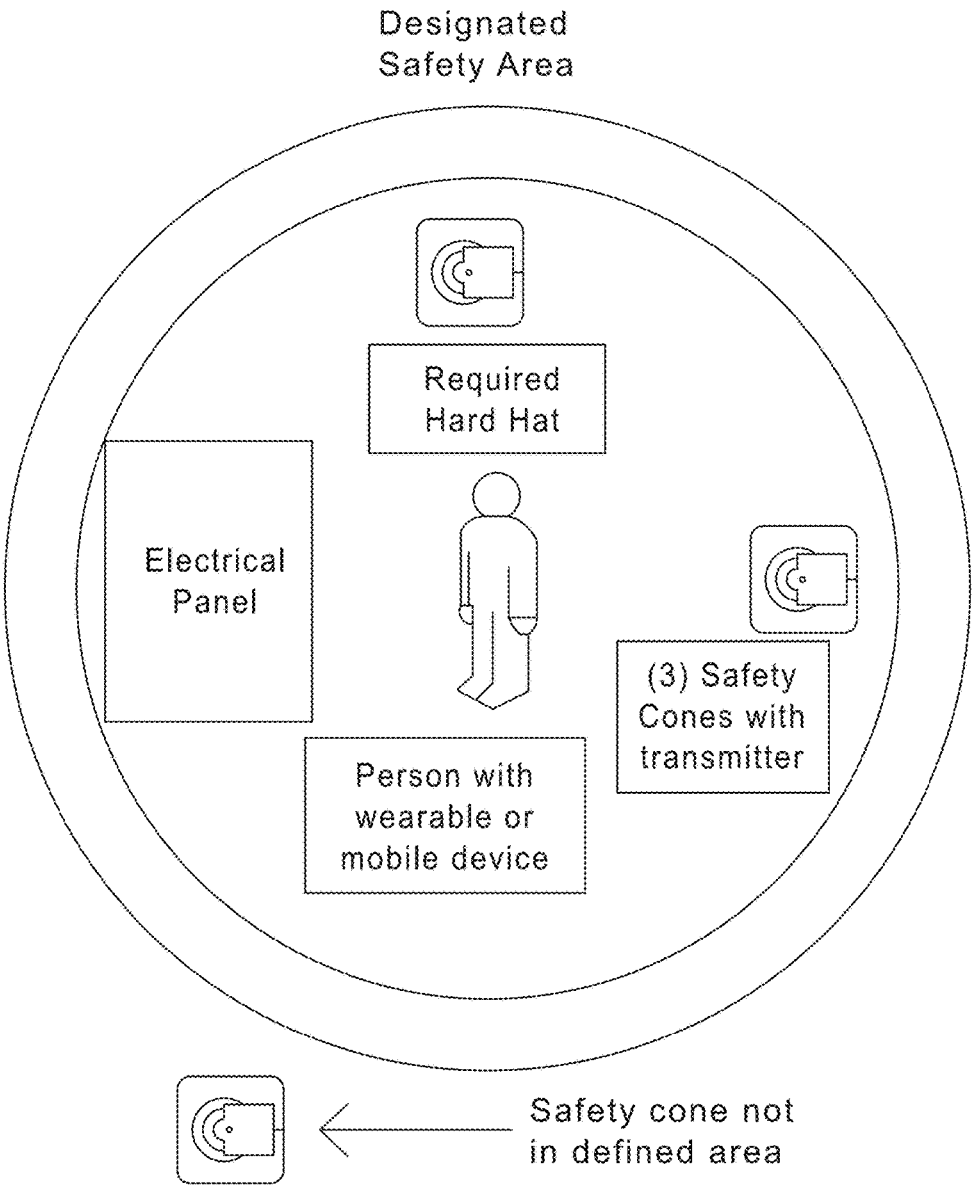
FIG. 5 represents a typical deployment of enabling commonly used safety devices with a wireless sensor.

FIG. 5 represents a typical deployment of enabling commonly used safety devices with a wireless sensor. The person is approaching an electrical panel that has a defined safety area around it, indicated by the dashed circle. The safety procedure in this example requires the use of the following equipment: (3) safety cones, hard hat, and an authorized person with wearable/mobile device. However, the picture shows that one of the cones is outside the designated safety area therefore the system is not in full compliance. If all of the conditions are not met the system will trigger an output and log the event. Typically, the output may be an indicator light, audible alarm, event log, or a restriction of entry to an electrical panel. The system will also continue to monitor these devices so if any are removed during the operation an indicator will be triggered.

A third aspect of the system described in this application enables the safety of personnel in an environment where restricted areas exist. Enabling technology for this invention is the use of a wireless system and a basic software application. Bluetooth low energy is one example of a wireless technology that can be used for this application. Other wireless technologies may include WiFi, NFC, or even other Bluetooth variants. In this invention a wireless transmitter is located on a person and/or equipment. The transmitter can be in the form of a wearable (wrist band, ID badge, etc.) or a mobile device (phone, tablet, etc.) and will wirelessly send a signal that is picked up by the receiving device. The receiving device is in the restricted area (hazardous area, top secret area, under construction, etc.) or on or near an electrical enclosure. These two pieces of hardware will provide the software system with enough data to output a meaningful response.

The software component of this system will determine the access level of the wearable transmitter on people or installed transmitter on equipment. Access level is typically determined by training and/or type of position. For example, only people in process engineering positions are permitted to enter the processing manufacturing area. This control metric can be changed dynamically so if an access level needs to be changed it can be done quickly. Typical system outputs can include the following: indicator light, audible alarm, or email/text notification. The intent of the system is to be an easy-to-use setup that does not require significant IT resources.

Figure 6:
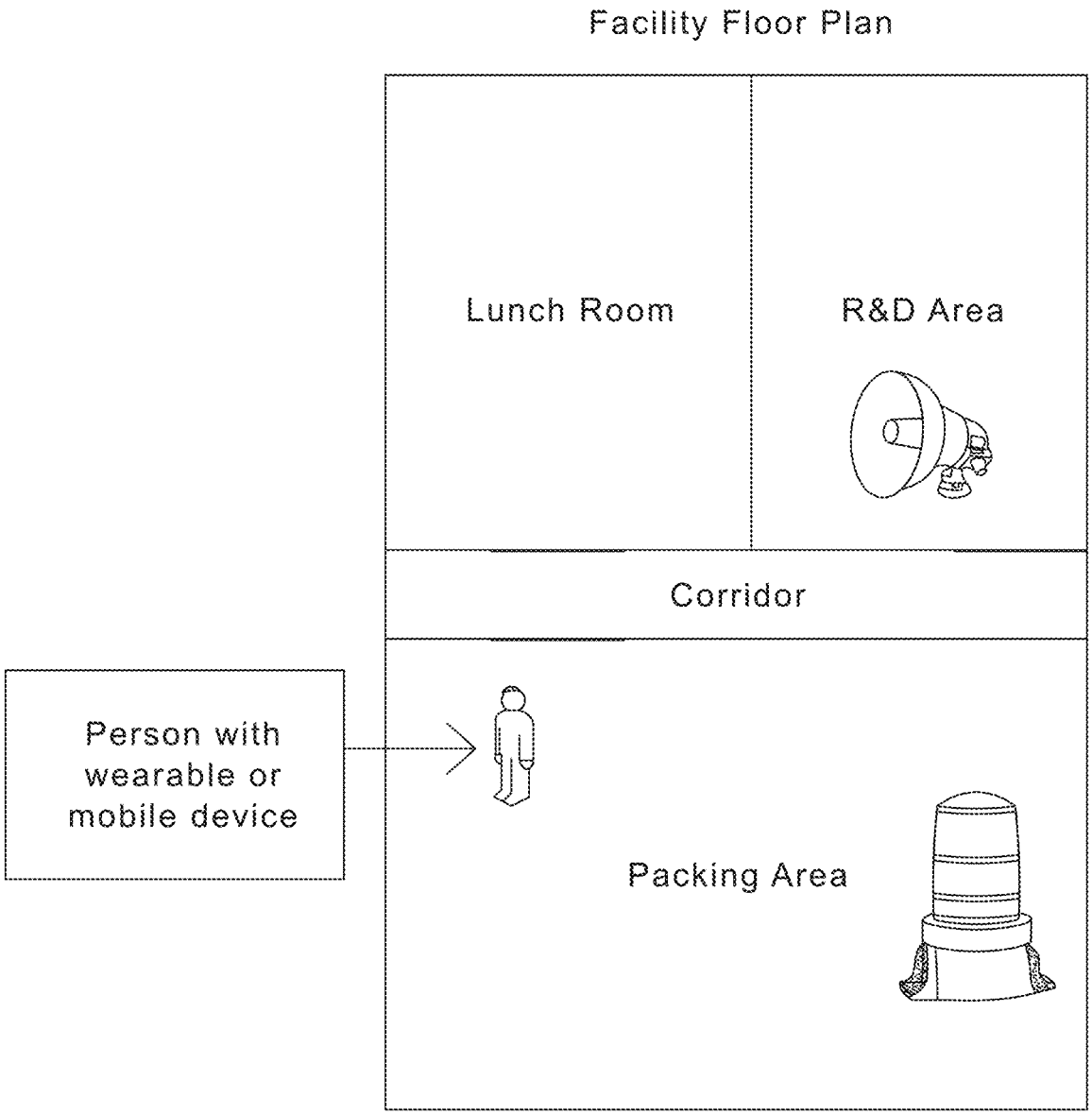
FIG. 6 shows a floor plan layout of how restricted areas can be utilized.
Figure 7:
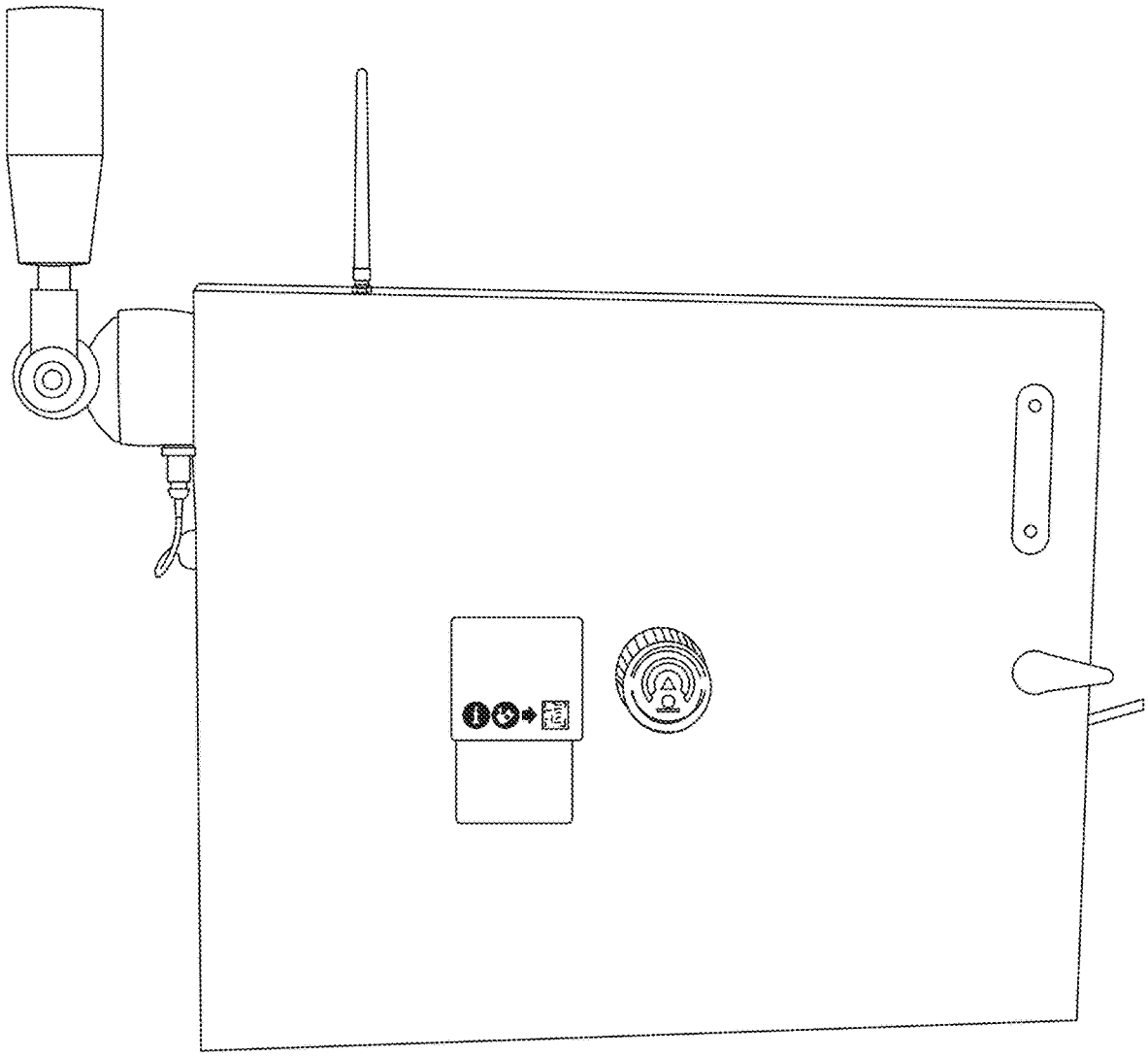
FIG. 7 shows an electrical panel with an AVT device mounted on the front.

The system can be deployed in different applications such as the following use case examples:

1. Restricted Area
   a. Facilities may restrict certain areas and providing an indicator on when someone is entering, or has entered, one of these areas can provide value. Something as simple as an indicator light to remind a person may be enough otherwise a stronger reminder such as an audible horn or text message may be required. FIG. 6 shows a floor plan layout of how restricted areas can be utilized. In this example only certain individuals have access to the R&D area, shaded in red, while the green areas are common for everyone. Since R&D is a higher access level an audible alarm is activated if an unauthorized person enters but if an unauthorized person wanders into the yellow packaging area, a light illuminates to indicate the event. There are many ways to setup these output indicators and all of these events can be logged in the software system.
2. Accessing an Electrical Panel
   a. Only qualified personnel are permitted to open an electrical panel. If the panel is equipped with an absence of voltage detector the system can log if it was used prior to opening the panel. In some cases, the electrical panel may not to be serviced with the power still on. Prior to servicing the live electrical panel, the safety plan may require certain equipment/devices be present, such as safety cones or PPE. If the required equipment/devices are equipped with wireless transmitters this data can be all monitored and recorded. These types of events can all be logged in detail based on the time of activity. FIG. 7 shows an electrical panel with an AVT device mounted on the front and an indicator on the upper left. The indicator will turn green if the panel is opened by an authorized person that has successfully run an AVT test. However, if the AVT test was not activated or if the person is not authorized the indicator will turn red. Therefore, if someone notices a person working in a panel with a red light, they know it is unauthorized.
3. Visitor Escort
   a. A visitor to the building may require an escort, in this case both people must be detected each time otherwise the visitor may have lost their escort.
4. Work Order Confirmation
   a. Only allow access to an area if the proper work order was processed. If maintenance people enter a restricted area without work order this event is logged. This verification is valuable for a 'hot' permit or something that is time bound.
5. Mandatory Presence
   a. A person may be required to 'check in' somewhere or spend a certain amount of time in an area. This system can be setup to confirm that a person entered a specific area and the amount of time in the area can be logged in the system.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

The invention claimed is:

1. A method of providing a user access to an enclosure with an absence of voltage testing device (AVT) for testing a voltage source within the enclosure comprising:

initiating an absence of voltage test via the AVT;

determining whether the user has appropriate authorization; and providing access to the enclosure.

2. The method of claim 1 further comprising determining whether the user has appropriate safety equipment before providing access to the enclosure.

3. The method of claim 1 further comprising continuously monitoring whether the user is still in proximity to the enclosure while the enclosure is being accessed.

4. The method of claim 3 further comprising continuously monitoring whether the user has the appropriate equipment while the enclosure is being accessed.

5. A system for providing a user with access to an enclosure with an absence of voltage testing device (AVT) for testing a voltage source within the enclosure comprising:

an enclosure with an AVT and an electronic lock wherein the AVT and the electronic lock are connected to a control system; and a wearable device configured to be worn by the user, the wearable device configured to detected by the control system and able to determine a proximity of the device to the enclosure, the wearable device also configured to provide authorization credentials to the control system.

6. The system of claim 5 further comprising safety equipment wherein the safety equipment is configured to be detected by the control system and able to determine a proximity of the safety equipment to the enclosure the wearable device.

* * * * *